US012054319B2

(12) United States Patent
Miller et al.

(10) Patent No.: US 12,054,319 B2
(45) Date of Patent: Aug. 6, 2024

(54) CHAIN STORAGE CASE

(71) Applicant: Seek Holdings, LLC, Independence, KY (US)

(72) Inventors: Kellee K. Miller, Independence, KY (US); Scott E. Miller, Independence, KY (US)

(73) Assignee: Seek Holdings, LLC, Indpendence, KY (US)

( * ) Notice: Subject to any disclaimer, the term of this patent is extended or adjusted under 35 U.S.C. 154(b) by 147 days.

(21) Appl. No.: 17/868,882

(22) Filed: Jul. 20, 2022

(65) Prior Publication Data

US 2024/0025602 A1 Jan. 25, 2024

(51) Int. Cl.
*B25H 3/00* (2006.01)
*B65D 43/16* (2006.01)

(52) U.S. Cl.
CPC .... *B65D 43/16* (2013.01); *B65D 2543/00101* (2013.01)

(58) Field of Classification Search
CPC .... B65D 85/00; B65D 73/0014; B65D 25/00; A45C 11/16; A45C 13/02; B27B 17/00; B27B 17/0008; B25H 3/006; B25H 3/00
USPC ..... 206/349, 6.1, 566, 348; 211/85.2
See application file for complete search history.

(56) References Cited

U.S. PATENT DOCUMENTS

| | | | | |
|---|---|---|---|---|
| 6,685,023 | B2 * | 2/2004 | Bleggi | A45C 11/16 211/85.2 |
| 9,346,608 | B2 | 5/2016 | Sublett | |
| 10,688,650 | B2 * | 6/2020 | Feaver | B25H 3/02 |
| 2004/0154935 | A1 * | 8/2004 | Kaminski | A45C 13/02 206/6.1 |
| 2005/0139499 | A1 | 6/2005 | Flynn | |
| 2009/0152149 | A1 | 6/2009 | Allen | |
| 2014/0084124 | A1 * | 3/2014 | Crank | A45C 11/00 248/346.07 |
| 2015/0083620 | A1 * | 3/2015 | McGarry | B27B 17/0008 206/349 |
| 2015/0314469 | A1 | 11/2015 | Conklin | |
| 2020/0016738 | A1 | 1/2020 | Feaver | |

OTHER PUBLICATIONS

Design U.S. Appl. No. 29/770,190, entitled "Case for Chainsaw Chains," filed Feb. 10, 2021.

* cited by examiner

*Primary Examiner* — King M Chu
(74) *Attorney, Agent, or Firm* — Frost Brown Todd LLP

(57) ABSTRACT

A storage case for storing chains includes upper and lower case portions. The lower case portion includes a base wall, a sidewall extending upwardly from and surrounding the base wall to define an elongate cavity, and a plurality of protrusions extending upwardly from the base wall within the elongate cavity. The lower case portion is configured to contain a chain in an expanded state in which the chain is constrained at first and second chain ends by respective first and second protrusions. The upper case portion is movable relative to the lower case portion between a closed position and an open position.

20 Claims, 8 Drawing Sheets

CHAIN STORAGE CASE

BACKGROUND

Chains are commonly used throughout various industries for transferring energy and for decorative purposes, for example. Storing chains, whether for transport or stationary storage, has been commonly associated with the usage of chains. While various types of containers for storing such chains have been made and used, it is believed that that no one prior to the inventors has made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
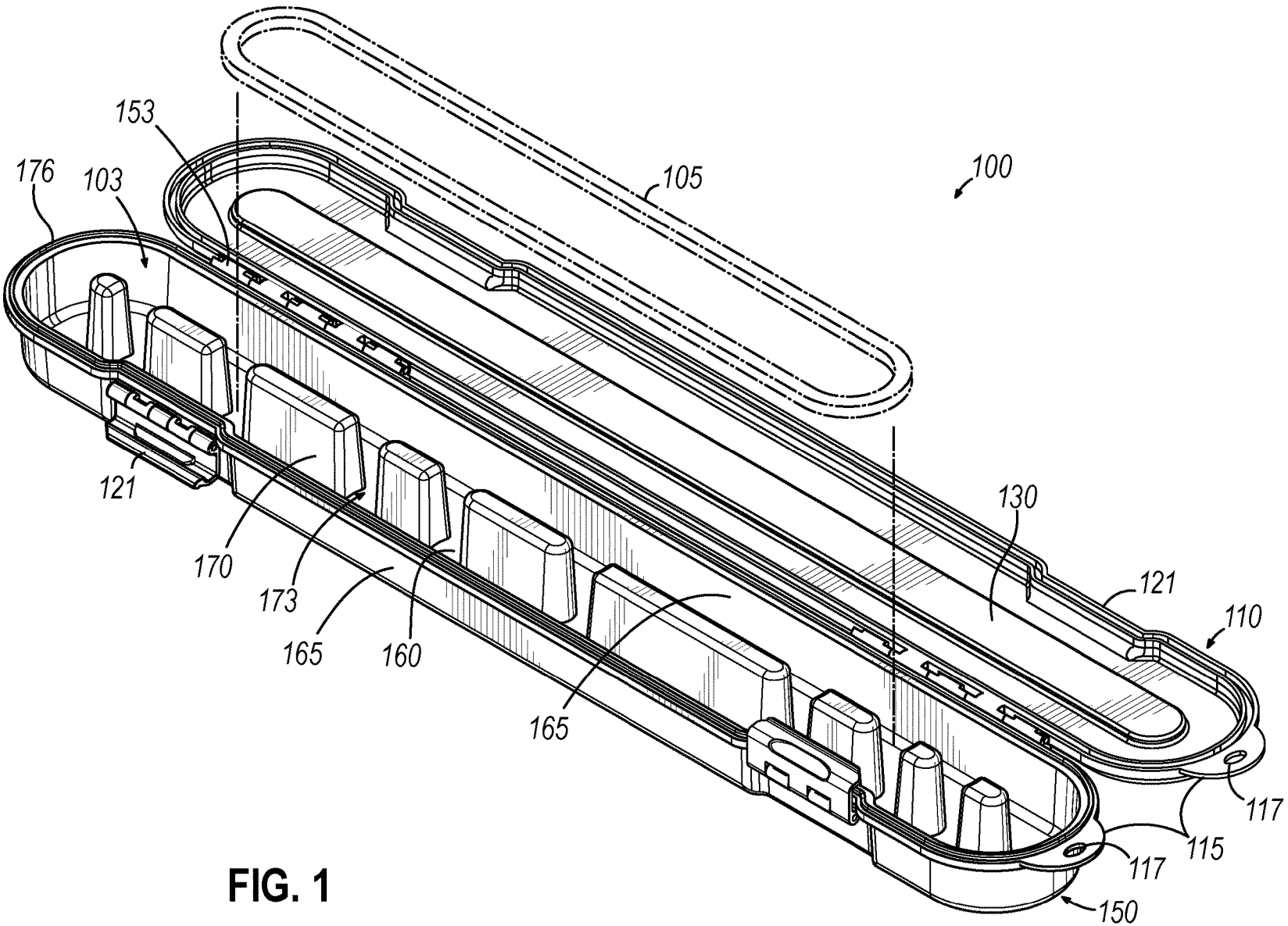
FIG. 1 depicts a front perspective view of an exemplary chain storage case in an open state, schematically showing a chain being positioned for insertion into a lower case portion of the chain storage case.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

For clarity of disclosure, the terms "proximal" and "distal" are defined herein relative to a user. The term "proximal" refers to the position of an element arranged closer to the user, and the term "distal" refers to the position of an element arranged further away from the user. To the extent that spatial terms such as "top," "bottom," "upper," "lower," "vertical," "horizontal," or the like are used herein with reference to the drawings, it will be appreciated that such terms are used for exemplary description purposes only and are not intended to be limiting or absolute. In that regard, it will be devices such as those disclosed herein may be used in a variety of orientations and positions not limited to those shown and described herein.

Furthermore, the terms "about," "approximately," and the like as used herein in connection with any numerical values or ranges of values are intended to encompass the exact value(s) referenced as well as a suitable tolerance that enables the referenced feature or combination of features to function for the intended purpose described herein.

I. Exemplary Chain Storage Case

As used herein, the term "chain" generally refers to a chain in a closed configuration such that the chain has no free ends and is configured to assume various closed shapes, such as an elliptical shape, for example. In some instances, it may be desirable to provide a storage case for a chain that keeps the chain untangled in an expanded state, and thus readily available for immediate use. If left uncontained, chains, and particularly chains built for high stress applications such as chainsaw chains or drive chains, may become tangled which can make them unsuited for their intended purpose until they are untangled. Untangling a chain may take an extended period of time depending on such factors as the length of the chain, the number of tangles in the chain, the size of the chain, the area available to untangle the chain, and any other limitations that a user may have when untangling the chain, such as limited dexterity while wearing gloves.

Each of the exemplary chain storage cases (100, 200) described below in connection with the figures is configured to securely contain one or more chains, which may be in the form of chainsaw chains, other cutting chains, power transmission chains, security chains, decorative chains, jewelry chains, or any other types of closed-loop chains. Furthermore, while storage cases (100, 200) are shown and described herein in connection with storing chains, it will be appreciated that storage cases (100, 200) may be utilized for storing various other types of non-chain articles having a closed-loop configuration similar to that of a chain. In that regard, it will be understood that each storage case (100, 200) may be suitably sized, for example with the depicted dimensional proportions, to contain any desired types of chains or other closed-loop articles.

FIG. 1 shows a first exemplary chain storage case (100) that includes an upper case portion (110) and a lower case portion (150). As described in greater detail below, chain storage case (100) is configured to contain one or more chains (105) (shown schematically) in an expanded, untangled state such that the one or more chains (105) are constrained in an organized state that allows for easy access and removal by a user when desired. Chain storage case (100), particularly upper case portion (110) and lower case portion (150), may be constructed of metal, plastic, or composite which is stiff enough to support and hold a chain (105) but also to support stacking various items on top of chain storage case (100) when it is involved in an industrial application such as being placed at the bottom of a job box with other equipment on top of it. An exemplary material for chain storage case (100) is polypropylene, which may be selected for its recyclability, resistance to sun damage, wear resistance, and resistance to staining and degradation; particularly degradation due to gas and oil. In some versions, chain storage case (100) may be designed and assembled in such a way as to allow multiple chain storage cases (100) to nest within one another when in an open position to allow for more efficient storage and shipment.

Figure 2:
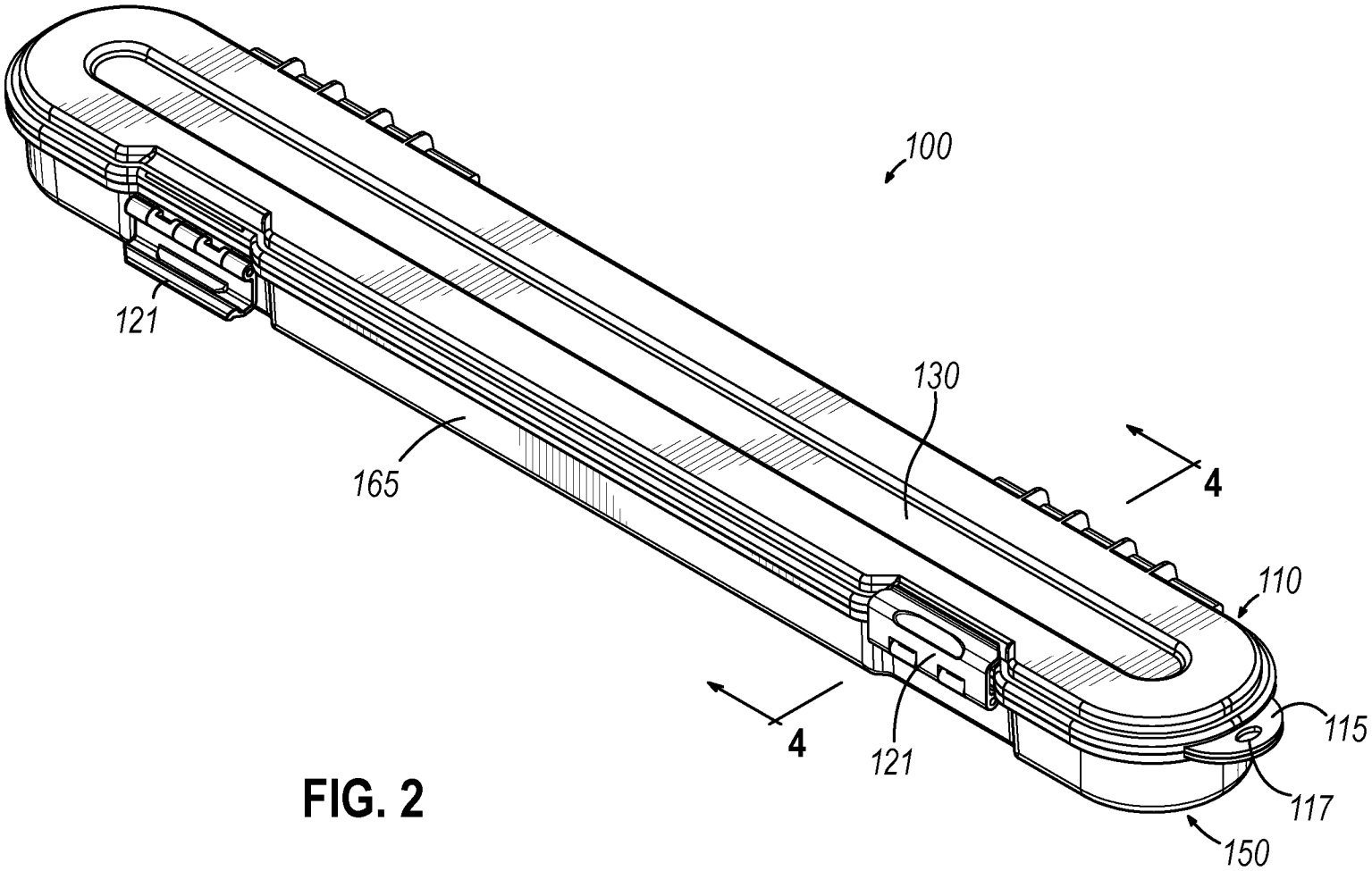
FIG. 2 depicts a front perspective view of the chain storage case of FIG. 1 in a closed state.

Upper and lower case portions (110, 150) are hingedly coupled together to provide chain storage case (100) with a generally elongated configuration having a stadium shape with rounded longitudinal ends. At least one hinge (153) is positioned along mating edges of case portions (110, 150). Hinge (153) pivotably couples upper case portion (110) with lower case portion (150) along the edge and enables upper case portion (110) to pivot relative to lower case portion (150) between an open position (FIG. 1) to provide case (100) in an open state, and a closed position (FIG. 2) to provide case (100) in a closed state. In the current example, two hinges (153) are located along elongated rear mating edges of case portions (110, 150) and are in the form of piano hinges configured to enable upper case portion (110) to pivot greater than one-hundred and eighty degrees relative to lower case portion (150) such that when lower case portion (150) is placed on a flat surface, a top portion of upper case portion (110) is also capable of pivoting to come into contact with the flat surface. Each hinge (153) may include a first hinge portion that is formed integrally with or otherwise rigidly secured to a upper case portion (110), and a second hinge portion that is formed integrally with or otherwise rigidly secured to lower case portion (150). Additionally, each hinge (153) of the present version includes a hinge pin (155) (shown in FIG. 4), which may be of a material with increased shear strength relative to upper case portion (110) and lower case portion (150), such as a metal like stainless steel. While hinges (153) of the present version are shown and described in the form of piano hinges, it will be appreciated that in other versions hinges (153) may be of various other suitable types readily apparent to those of ordinary skill in the art in view of the teachings herein.

Chain storage case (100) may include a mount tab (115) on an exterior portion of either or both of upper case portion (110) and lower case portion (150), such as the longitudinal ends of case portions (110, 150). Each mount tab (115) is configured to both support chain storage case (100) when it is hung and to secure it from opening unintentionally. Each mount tab (115) may be configured with enough structural material to support chain storage case (100) when hung in a vertical orientation and with chains loaded inside chain storage case (100). Each mount tab (115) may include a hole (117) for hanging chain storage case (100) on a wall-mounted peg or other hanging support structure for securing chain storage case (100) in a hung state. Mount tabs (115) may be formed integrally with upper case portion (110) and lower case portion (150), and holes (117) are configured to coaxially align when case (100) is in a closed state such that a hanging support structure or a locking member may be directed through holes (117).

Chain storage case (100) may also include one or more latches (121) configured to releasably retain upper case portion (110) and in the closed position relative to lower case portion (150). Each latch (121) may be affixed to either upper case portion (110) or lower case portion (150) and may be configured as a single throw latch, a double throw latch, a slide latch, a draw latch, a bolt latch, a spring latch, a cam latch, a gate latch, a magnetic latch, a hasp, a hook and eye latch, a lockable latch, or various other types suitable to releasably maintain case (100) in a closed state. In the current example, chain storage case (100) includes two latches (121) on lower case portion (150) which are configured to engage with corresponding features of upper case portion (110) to maintain chain storage case (100) in the closed position. Each latch (151) may include a pivot pin (125) (shown in FIG. 4) constructed of a material with increased shear strength relative to upper case portion (110) and lower case portion (150), such as a metal like stainless steel. Latch (121) may be recessed into upper case portion (110) and/or lower case portion (150) such that latch (121) is flush with or recessed relative to an edge of chain storage case (100) when chain storage case (100) is in a closed and latched state.

Figure 4:
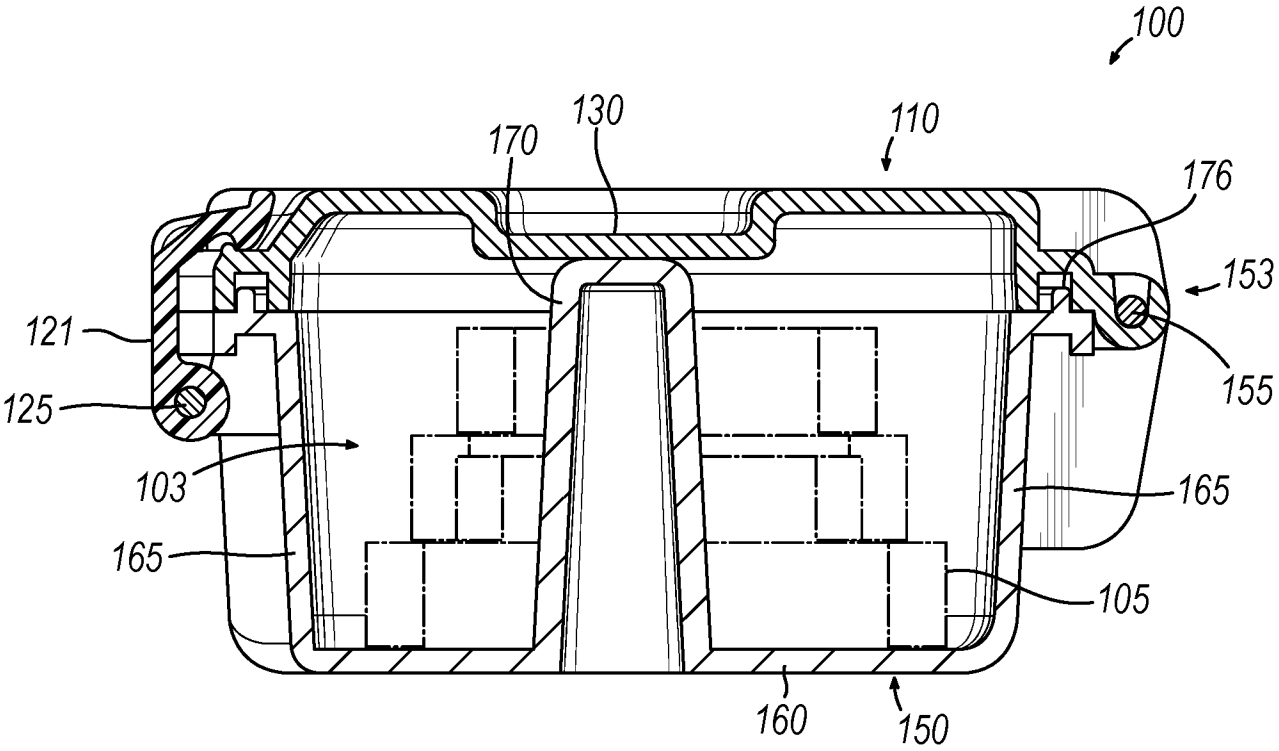
FIG. 4 depicts a sectional side view of the chain storage case of FIG. 1 in the closed state, taken along section line 4-4 in FIG. 2.

Lower case portion (150) includes a base wall (160), a sidewall (165) extending upwardly from and surrounding base wall (160) to define an elongate cavity (103), and a plurality of protrusions (170) extending upwardly from base wall (160) within elongate cavity (103). The plurality of protrusions (170) is fixed relative to base wall (160) and may be configured in a linear array along a longitudinal centerline of base wall (160) such that protrusions (170) are separate from and spaced inwardly of sidewall (165). Additionally, protrusions (170) are spaced apart from one another in a longitudinal direction with a gap (173) between each longitudinally adjacent pair of protrusions (170). Protrusions (170) may vary in size and shape relative to one another. In the present version, each protrusion (170) is formed with a generally elongate cross-sectional shape having at least one rounded longitudinal end. The rounded longitudinal end of each protrusion (170) is configured to reduce friction between the protrusion (170) and a chain (105) wrapped around the protrusion (170). Additionally, as shown in FIGS. 1 and 4, each protrusion (170) may taper in a vertical direction away from base wall (160) to facilitate ease of insertion and removal of chain (105) from cavity (103), and to facilitate formation of lower case portion (150) by injection molding.

An upper lip of lower case portion (150) further includes a first sealing feature in the form of a ridge (176) configured to engage a corresponding second sealing feature in the form of a groove formed in a lower lip of upper case portion (110) to create a seal between upper case portion (110) and lower case portion (150) when chain storage case (100) is in the closed state. This engagement may keep water and debris out of cavity (103) of chain storage case (100) or may keep oil or other lubricating fluids inside cavity (103). In some versions, though not shown, a gasket may be positioned within the groove to create a more secure seal, such as an air-tight seal, when case (100) is in the closed state.

Upper case portion (110) may include a recessed portion (130) which is centrally located along a centerline of upper case portion (110) and is configured to add structural rigidity to chain storage case (100). As shown in FIGS. 1 and 4, recessed portion (130) extends toward the tops of protrusions (170) when case (100) is in the closed state to thereby constrain one or more chains (105) relative to protrusions (170), as described further below. A top surface of recessed portion (130), shown in FIG. 2, may be provided with indicia that is embossed or printed, for example.

Figure 3:
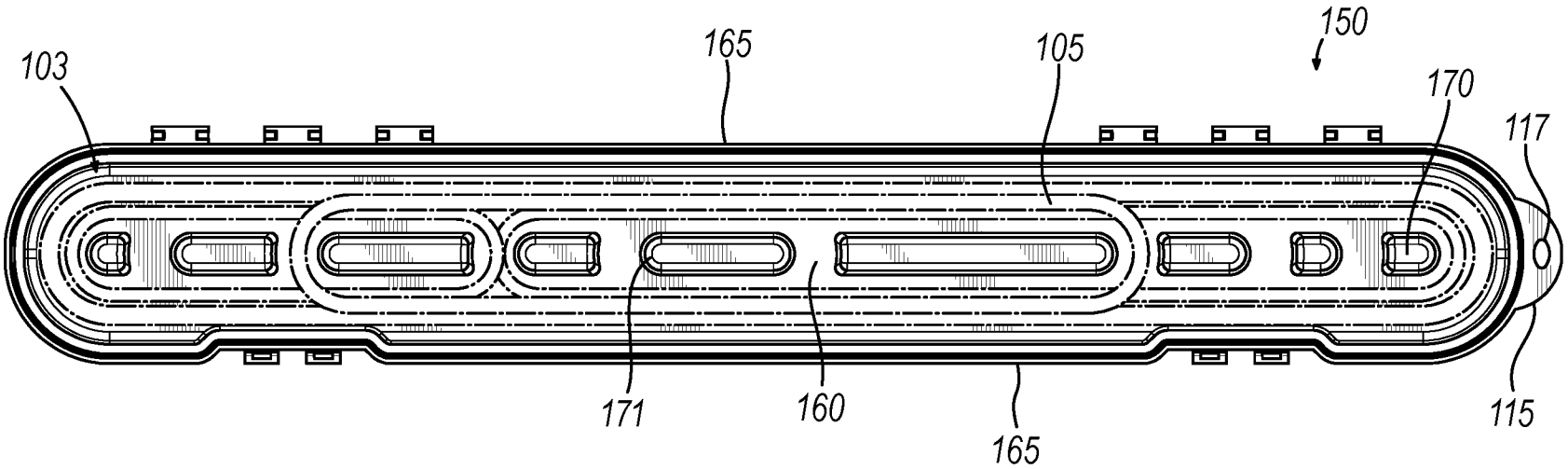
FIG. 3 depicts a top plan view of the lower case portion of the chain storage case of FIG. 1 with an upper case portion omitted from view, schematically showing a plurality of chains positioned within the lower case portion.

FIG. 3 shows a top view of lower case portion (150) with a schematic depiction of various chains (105) positioned among the plurality of protrusions (170). Each chain (105)

has a unique length when in an expanded, untangled state and is constrained at opposed ends by a respective pair of protrusions (170). More specifically, each chain (105) is constrained within case (100) in an expanded state in which the chain (105) defines a first chain end, an opposed second chain end, and a pair of elongate chain sides that are non-overlapping and define a generally elliptical or stadium-like closed shape. Each end of the chain (105) is constrained both longitudinally and laterally by being wrapped around a respective protrusion (170) that serves as an anchor, and chain (105) thus encircles the two anchor protrusions (170) in combination with any intervening protrusions (170) positioned therebetween. As a result, each elongate chain side of the chain (105) extends between a respective side of the plurality of protrusions (170) and sidewall (165), as seen in FIGS. 3 and 4. Chains (105) may be stacked on top of each other inside cavity (103) such that each chain (105) lies in a separate plane, for example as shown in FIG. 4. Additionally, or alternatively, chains (105) of various sizes may be nested within one another such that they lie in the same plane inside cavity (103). As described above, each protrusion (170) may include a rounded end (171), which can be semi-circular, configured to aid a chain (105) in sliding around protrusion (170) when chain (105) is being positioned around protrusions (170). The lateral spacing between protrusions (170) and sidewall (165) is sized small enough to prevent a chain (105) from becoming tangled inside cavity (103), but large enough to allow chain (105) to be easily inserted into and removed from cavity (103), for example even when the user is wearing safety gloves.

FIG. 4 shows a sectional view of chain storage case (100) in the closed and latched position. As indicated above, each protrusion (170) is formed with a sufficient height such that the protrusion (170) is configured to contact or directly confront a bottom surface of recessed portion (130) of upper case portion (110) when case (100) is in the closed state. This effectively constrains each stored chain (105) in a vertical direction within case and prevents the chain (105) from disengaging its respective protrusions (170) and becoming entangled while stored within case (100).

II. Exemplary Alternative Chain Storage Case

In some instances, it may be desirable to alter one or more features of chain storage case (100) described above to additional and/or longer chains. FIGS. 5-8 show an exemplary alternative chain storage case (200), which may be similar in structure and function to chain storage case (100) described above, as indicated by similar reference numerals, except as otherwise described below and/or shown in the drawings. It will be appreciated that additional variations of chain storage case (100) may be created that combine one or more features of any of the exemplary chain storage cases (100, 200) shown and described herein.

Figure 5:
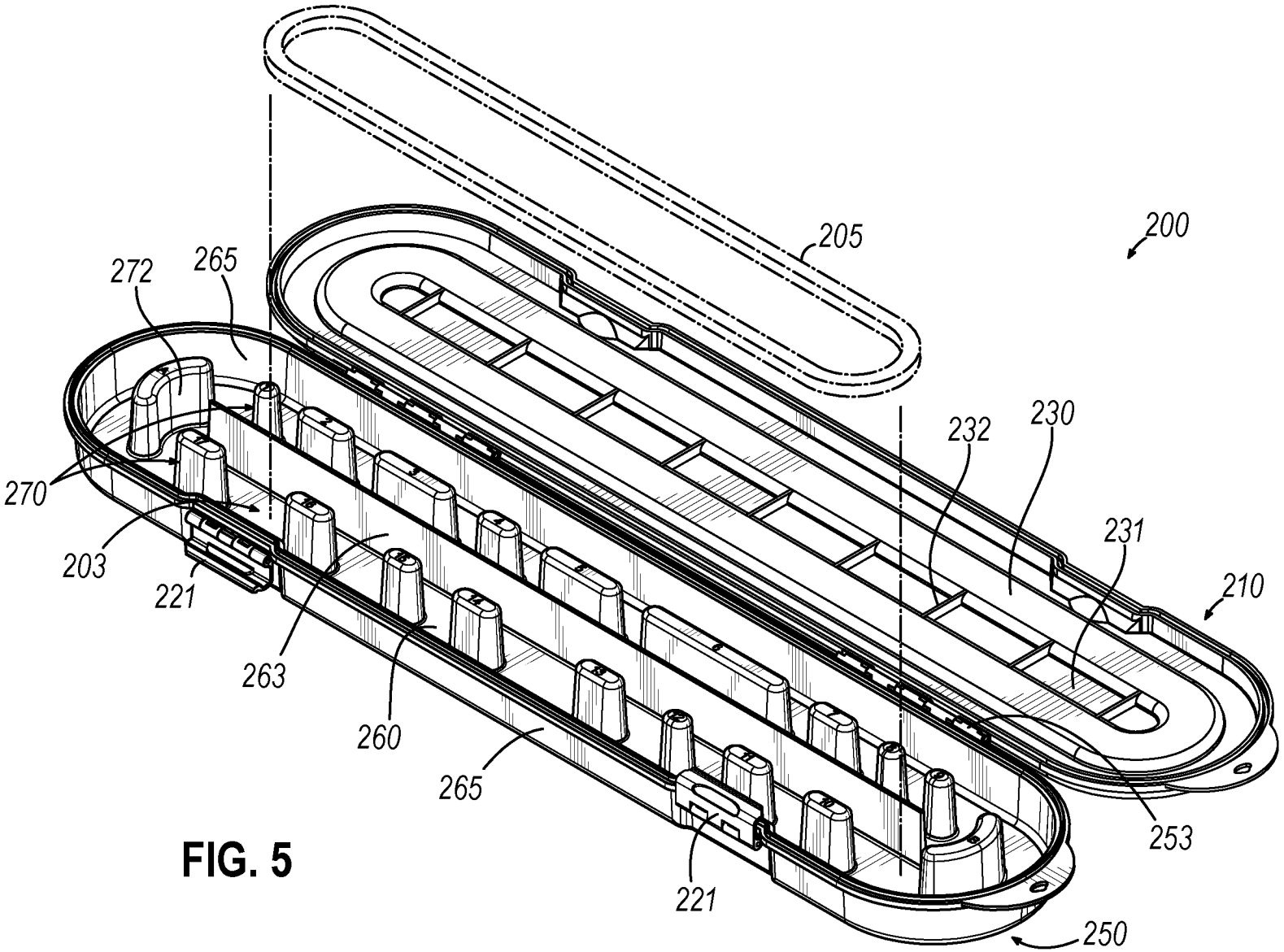
FIG. 5 depicts a front perspective view of a second exemplary chain storage case in an open state, schematically showing a chain being positioned for insertion into a lower case portion of the chain storage case.
Figure 6:
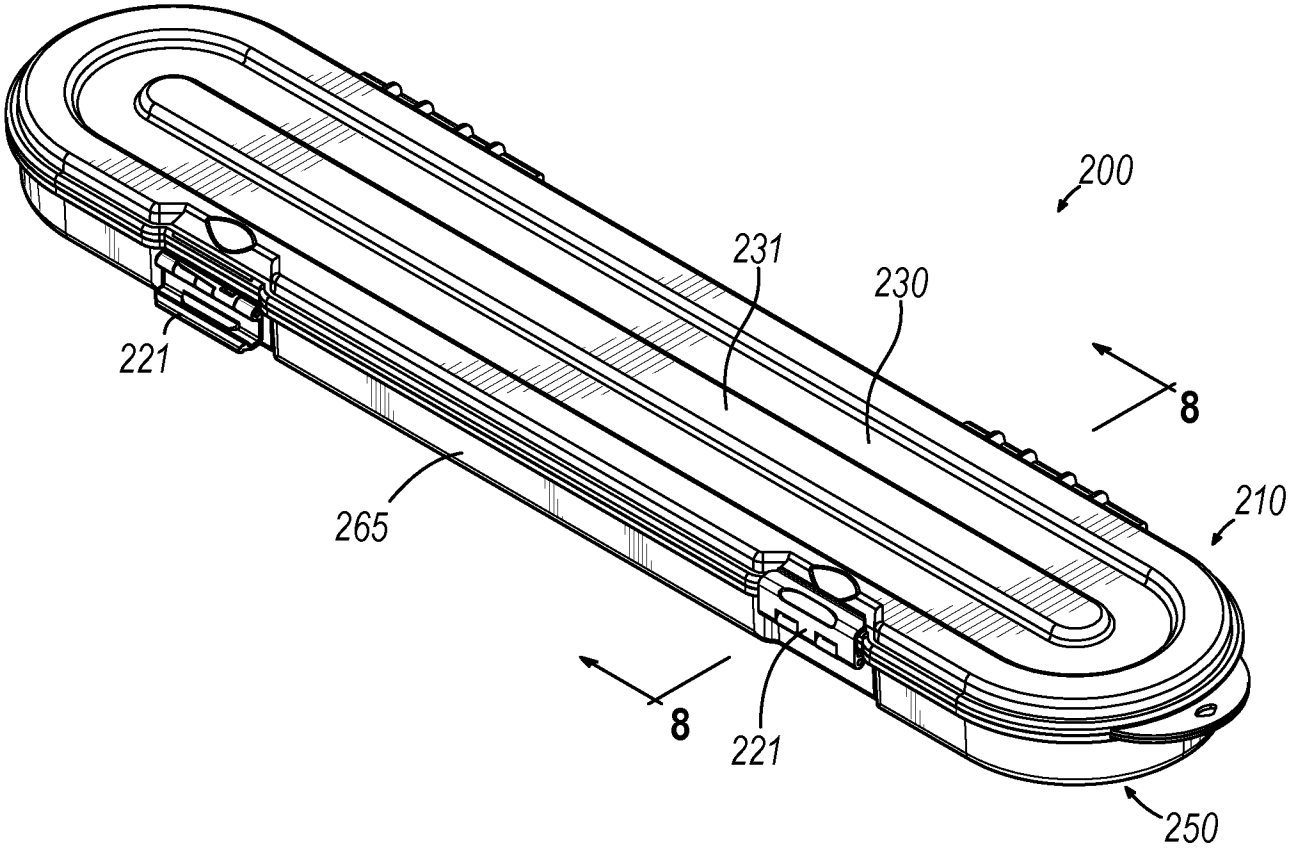
FIG. 6 depicts a front perspective view of the chain storage case of FIG. 5 in a closed state.

Chain storage case (200) includes an upper case portion (210) and a lower case portion (250) coupled together with a pair of hinges (253) and configured to transition between an open state (FIG. 5) and a closed state (FIG. 6). Case (200) further includes a pair of latches configured to releasably retain case (200) in the closed state.

Lower case portion (250) includes a base wall (260) and a sidewall (265) that surrounds base wall (260) and defines a cavity (203). Lower case portion (250) further includes first and second arrays of protrusions (270) disposed within cavity (203), with each array of protrusions (270) being linear and divided by a median (263) (i.e., a dividing wall) extending upwardly from base wall (260) along a longitudinal centerline of base wall (260). Median (263) divides cavity (203) into longitudinal first and second cavity portions that extend parallel to one another, with the first array of protrusions (270) disposed within the first cavity portion and the second array of protrusions (270) disposed within the second cavity portion. At opposite ends of median (263) within cavity (203) are end protrusions (272). Each end protrusion (272) is arc shaped with the inner radius of the arc being positioned towards the center of chain storage case (200). End protrusions (272) are configured to accommodate chains (205) having an expanded length that is longer than a single linear array of protrusions (270). An example of this is shown in FIG. 7 by an exemplary chain (205) having a first chain end anchored around a first protrusion (270) (marked "3") of the first linear array, a second chain end anchored around a second protrusion (270) (marked "13") of the second linear array, and an elongate chain side wrapping around an outer radius of an arcuate end protrusion (272) (marked "B").

Protrusions (270) of each linear array may be configured in the same or different orientations, shapes, and sizes as protrusions (170) of chain storage case (100). In the present version, the first linear array of protrusions (270) arranged nearest to hinge (253) have a similar size, orientation, and spacing as protrusions (170). By comparison, the second linear array of protrusions (270) nearest latch (221) have a different size, orientation, and spacing than the first array. While case (200) of the present version is shown having two linear arrays of protrusions (270) separated by a single median (263) and having a single pair of end protrusions (272) disposed at the ends of median (263), cases (200) of other versions may include any suitable quantity of linear arrays of protrusions (270), medians (263), and end protrusions (272).

As shown best in FIGS. 5-6, upper case portion (210) includes a recessed portion (230) that is configured like a stadium-shaped racetrack, and an elongate raised portion (231) located centrally within recessed portion (230). Though not shown, a top surface of upper case portion (210) may include indicia that is embossed or printed, for example on a top surface presented by recessed portion (230) and/or raised portion (231). As shown in FIG. 5, an underside of upper case portion (210) includes a plurality of ribs (232) that span transversely across raised portion (231) from one elongate section of recessed portion (230) to the opposed elongate section of recessed portion (230). Ribs (232) may therefore enhance a rigidity of upper case portion (210), as well as cooperate with median (263) of lower case portion (250) to further constrain a chain relative to protrusions (270), as shown and described in greater detail below in connection with FIG. 8.

Figure 7:
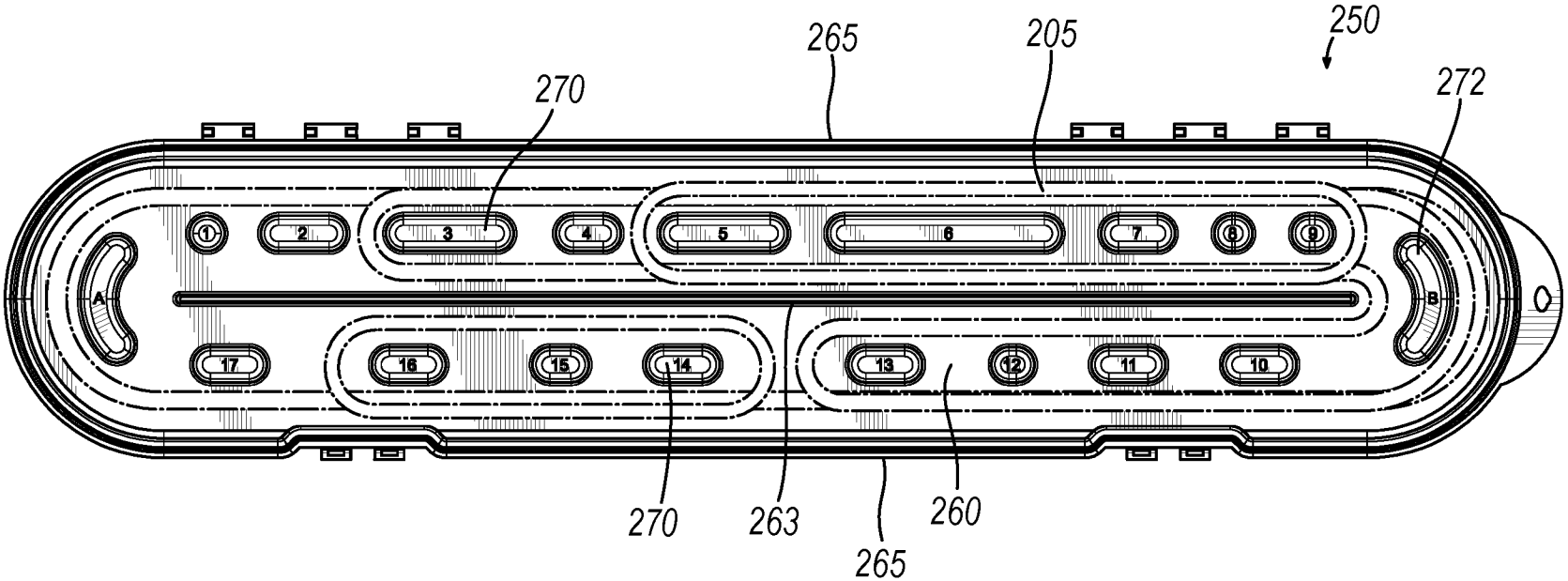
FIG. 7 depicts a top plan view of the lower case of the chain storage case of FIG. 5 with an upper case portion omitted from view, schematically showing a plurality of chains positioned within the lower case portion.

FIG. 7 shows a top view of lower case portion (250) with a schematic depiction of various chains (205) positioned among the plurality of protrusions (270). Each chain (205) may span across multiple protrusions (270) with the protrusions (270) constraining the chain (205) and preventing tangling when case (200) is closed. Some chains (205) are longer than a single linear array of protrusions (270). In this situation, as described above, chain (205) may be stored within case (200) by wrapping a first chain end around a protrusion (270) of the first array, positioning a first elongate portion of chain (205) between median (263) and a corresponding end protrusion (272), positioning another elongate portion of chain (205) around the outside of end protrusion (272), and then wrapping the second chain end of chain (205) around a suitable protrusion (270) of the second array. In instances in which chain (205) is longer than each of the first and second arrays of protrusions (270) combined, chain (205) may be positioned around protrusions (270, 272) in a manner that allows chain (205) complete more than one complete circuit around protrusions (270, 272) such that chain (205) may stack on itself.

Protrusions (170) of chain storage case (100) and protrusions (270, 272) of chain storage case (200) may be sized and spaced to accommodate one or more particular chain (205) sizes that are common in a particular industry. By way of example only, protrusions (170) of case (100) may be configured to constrain chainsaw chains configured for use with chainsaw bar sizes ranging from 6 inches to 20 inches in length, with case (100) being configured to hold 8 or more such chainsaw chains. Protrusions (270, 272) of case (200) may be configured to constrain chainsaw chains configured for use with chainsaw bar sizes ranging from 6 inches to 42 inches or longer, with case (200) being configured to hold at least one such chain depending on the length of chain(s) being stored. For visual guide purposes, each protrusion (270) of case (200), moving clockwise starting with the upper left circularly shaped protrusion (270) of FIG. 7, may be visibly labelled "1" through "17," with end protrusions (272) being labelled "A" on the left and "B" on the right. As an example only, case (200) may be configured to store one or more chainsaw chains configured for various chainsaw bar sizes in the following exemplary configurations with reference to protrusions (270, 272) as labeled per above:

TABLE 1

Exemplary Chainsaw Chain Fitment

| Chainsaw Bar Size | Chain Fitment |
|---|---|
| 22" | 5-12 |
| | 9-16 |
| | 11-1 |
| | A-8 |
| 24" | 8-16 |
| | 1-B |
| | 16-6 |
| | A-9 |
| 32" | 8-1 |
| | 10-4 |
| | 15-9 |
| 36" | 8-2 |
| | 2-14 |
| | B-4 |
| | 10-5 |
| 42" | 6-2 |
| | 7-4 |
| | 9-5 |
| | 2-16 |

Figure 8:
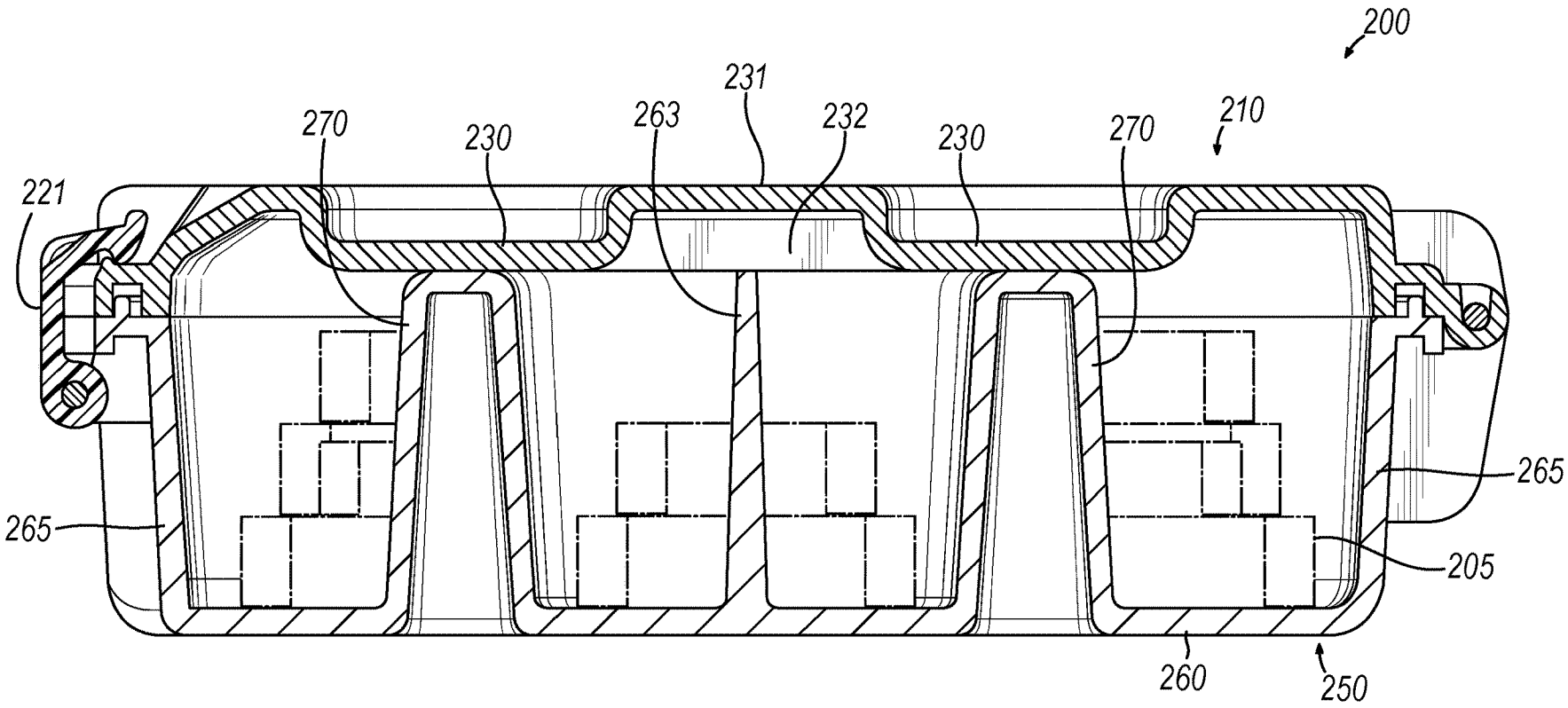
FIG. 8 depicts a sectional side view of the second chain storage case of FIG. 5 in the closed state, taken along section line 8-8 in FIG. 6.

As shown in FIG. 8, the first and second arrays of protrusions (270) are divided by median (263). Similar to protrusions (170), each protrusion (270) extends upwardly to a sufficient height to either directly contact or confront a bottom surface of recessed portion (230) of upper case portion (210). Similarly, median (263) extends upwardly to a height sufficient to either directly contact or confront the undersides of ribs (232) of upper case portion (210). Collectively, these interactions between protrusions (270) and median (263) of lower case portion (250) with recessed portion (230) and ribs (232) of upper case portion (210) inhibit each chain (205) from disengaging protrusions (270) and traversing between the first and second elongate portions of cavity (203) to otherwise become entangled when chain storage case (200) is in the closed state.

While Each Of

III. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A storage case comprising:

(a) a lower case portion comprising:

(i) a base wall, (ii) a sidewall that extends upwardly from and surrounds the base wall, wherein the base wall and the sidewall define an elongate cavity, and (iii) a plurality of protrusions extending upwardly from the base wall within the elongate cavity, wherein the protrusions are fixed relative to the base wall and are longitudinally spaced apart from one another such that each pair of longitudinally adjacent protrusions are separated by a respective longitudinal gap, wherein each of the protrusions includes a first lateral side that faces a first wall of the lower case portion and a second lateral side that faces a second wall of the lower case portion such that no intervening portions of the lower case portion reside between the first and second lateral sides and the first and second walls, respectively, wherein at least one of the first wall or the second wall is defined by the sidewall, wherein the lower case portion is configured to contain a chain in an expanded state in which a first chain end of the chain is wrapped around and constrained by a first protrusion of the plurality of protrusions, and a second chain end of the chain is wrapped around and constrained by a second protrusion of the plurality of protrusions; and (b) an upper case portion, wherein the upper case portion is movable relative to the lower case portion between a closed position in which the upper case portion encloses the cavity and an open position in which the upper case portion exposes the cavity for access by a user.

2. The storage case of claim 1, wherein at least some protrusions of the plurality of protrusions differ in size and shape from one another.

3. The storage case of claim 2, wherein each protrusion of the plurality of protrusions varies in length in a direction parallel to a length of the storage case.

4. The storage case of claim 1, wherein each protrusion has at least one rounded end.

5. The storage case of claim 1, wherein each protrusion of the plurality of protrusions is hollow and integrally connected with the base wall.

6. The storage case of claim 1, wherein the plurality of protrusions are arranged in at least one linear array along a length of the storage case.

7. The storage case of claim 6, wherein the at least one linear array comprises a first linear array and a second linear array that is spaced apart from and parallel to the first linear array.

8. The storage case of claim 7, wherein the storage case further comprises a median wall defined by the other of the first wall or the second wall and positioned between the first linear array and the second linear array, wherein the median wall is configured to constrain the chain relative to the first linear array and the second linear array.

9. The storage case of claim 1, wherein the upper case portion further comprises a bottom surface configured to confront top surfaces of the protrusions when the case is in a closed state to thereby constrain the chain relative to the protrusions and inhibit the chain from disengaging the protrusions when the storage case in the closed state is inverted.

10. The storage case of claim 1, being further configured to simultaneously hold a first chain having a first expanded chain length and a second chain having a second expanded chain length that differs from the first expanded chain length.

11. The storage case of claim 1, further including at least one latch configured to maintain the storage case in a closed state.

12. The storage case of claim 1, wherein at least one of the protrusions has an elongate profile in a plane that extends parallel to the base wall, wherein the elongate profile has a length that extends parallel to a longitudinal axis of the lower case portion.

13. A storage case comprising:

(a) a lower case portion comprising:

(i) a base wall, (ii) a sidewall that extends upwardly from and surrounds the base wall, wherein the base wall and the sidewall define an elongate cavity, and (iii) a plurality of protrusions extending upwardly from the base wall within the elongate cavity, wherein the protrusions are spaced apart from one another such that each pair of adjacent protrusions are separated by a respective gap, wherein the plurality of protrusions includes:

(A) first and second protrusions configured to cooperate to constrain within the cavity a first chain in an expanded state with a first expanded chain length, and (B) third and fourth protrusions positioned longitudinally between the first and second protrusions, wherein the third and fourth protrusions are configured to cooperate to constrain within the cavity a second chain in an expanded state with a second expanded chain length, wherein the second expanded chain length is smaller than the first expanded chain length, wherein the first, second, third, and fourth protrusions are positioned between and confront opposed first and second walls of the lower case portion such that no intervening portions of the lower case portion protrude upwardly between any of the first, second, third, or fourth protrusions and the first and second walls, wherein at least one of the first wall or the second wall is defined by the sidewall; and (b) an upper case portion hingedly coupled with the lower case portion, wherein the upper case portion is pivotable relative to the lower case portion between a closed position in which the upper case portion encloses the cavity and an open position in which the upper case portion exposes the cavity for access by a user.

14. The storage case of claim 13, wherein at least some protrusions of the plurality of protrusions differ in size and shape from one another.

15. The storage case of claim 14, wherein each protrusion of the plurality of protrusions varies in length in a direction parallel to a length of the storage case.

16. The storage case of claim 13, wherein at least one of the protrusions is hollow.

17. The storage case of claim 13, wherein each of the first wall and the second wall spans continuously parallel to a longitudinal axis of the storage case from the first protrusion to the second protrusion.

18. A method of storing a chainsaw chain inside a storage case that includes a first case portion having a cavity and a plurality of stationary protrusions within the cavity, and a second case portion that is movable relative to the first case portion to transition the storage case between an open state and a closed state, the method comprising:

(a) with the storage case in the open state, receiving the chainsaw chain in an expanded state into the cavity;

(b) constraining the chainsaw chain at a first chain end with a first protrusion of the plurality of stationary protrusions such that the first chain end is wrapped around the first protrusion;

(c) constraining the chainsaw chain at a second chain end with a second protrusion of the plurality of stationary protrusions such that the second chain end is wrapped around the second protrusion, wherein the first and second protrusions are spaced apart from one another by a distance that remains fixed both before and after the chainsaw chain is constrained at its first and second chain ends; and (d) with the first and second protrusions remaining spaced apart from one another by the distance, engaging the first case portion with the second case portion to transition the storage case to the closed state in which the first case portion encloses the cavity and is configured to further constrain the chainsaw chain such that the first and second chain ends remain wrapped around the first and second protrusions, respectively.

19. The method of claim 18, further comprising:

(a) with the storage case in the open state, receiving a second chain in an expanded state into the cavity;

(b) constraining the second chain at a first chain end with a third protrusion of the plurality of stationary protrusions such that the first chain end of the second chain is wrapped around the third protrusion; and (c) constraining the second chain at a second chain end with a fourth protrusion of the plurality of stationary protrusions such that the second chain end of the second chain is wrapped around the fourth protrusion, wherein the third and fourth protrusions are spaced apart from one another.

20. The method of claim 18, wherein the first and second protrusions are immovable relative to one another.

* * * * *